US010852678B1

(12) United States Patent
Inomata

(10) Patent No.: US 10,852,678 B1
(45) Date of Patent: Dec. 1, 2020

(54) PRESSING DEVICE AND IMAGE PROCESSING APPARATUS

(71) Applicant: TOSHIBA TEC KABUSHIKI KAISHA, Tokyo (JP)

(72) Inventor: Toshiya Inomata, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/807,258

(22) Filed: Mar. 3, 2020

(51) Int. Cl.
*G03G 15/20* (2006.01)

(52) U.S. Cl.
CPC ..... *G03G 15/2064* (2013.01)

(58) Field of Classification Search
CPC ..... G03G 15/2064
See application file for complete search history.

(56) References Cited

U.S. PATENT DOCUMENTS

2011/0222881 A1* 9/2011 Yamada ..... G03G 15/2032 399/45
2012/0237229 A1* 9/2012 Okamoto ..... G03G 15/2032 399/33
2014/0270875 A1 9/2014 Mimbu et al.
2018/0341203 A1 11/2018 Ishida

FOREIGN PATENT DOCUMENTS

JP 2010-128132 6/2010
JP 2014-089238 5/2014

* cited by examiner

*Primary Examiner* — Victor Verbitsky
(74) *Attorney, Agent, or Firm* — Amin, Turocy & Watson, LLP

(57) ABSTRACT

A pressing rotator can contact a rotatable member. An arm rotatably supports the pressing rotator and changes the distance from a rotation center of the pressing rotator to the rotatable member by rotation. A pusher is rotatable around a rotation center of the arm. An elastic member is located between the arm and the pusher and biases the arm in a direction in which the pressing rotator contacts the rotatable member. A cam follower is mounted on the pusher. The cam can contact A cam follower and is rotatable around a first rotation center. The distance from the rotation center of the arm to the first rotation center of the cam is shorter than the distance from the rotation center of the arm to the center of the cam follower.

20 Claims, 7 Drawing Sheets

PRESSING DEVICE AND IMAGE PROCESSING APPARATUS

FIELD

Embodiments described herein relate generally to a pressing device and an image processing apparatus.

BACKGROUND

An image forming apparatus that forms an image on a sheet is used as an image processing apparatus. The image forming apparatus includes a pressing device for fixing toner to a sheet. The pressing device is required to prevent abnormal noise.

DETAILED DESCRIPTION

In general, according to one embodiment, the pressing device includes a rotatable member, a pressing rotator, an arm, a pusher, an elastic member, a cam follower, and a cam. The pressing rotator can contact the rotatable member. The arm rotatably supports the pressing rotator and changes the distance from a rotation center of the pressing rotator to the rotatable member by rotation. The pusher is rotatable around a rotation center of the arm. The elastic member is located between the arm and the pusher and biases the arm in a direction in which the pressing rotator contacts the rotatable member. The cam follower is mounted on the pusher. The cam can contact the cam follower and is rotatable around a first rotation center. The distance from the rotation center of the arm to the first rotation center of the cam is shorter than the distance from the rotation center of the arm to the center of the cam follower.

Hereinafter, a pressing device and an image processing apparatus according to the embodiment will be described with reference to the drawings.

Figure 1:
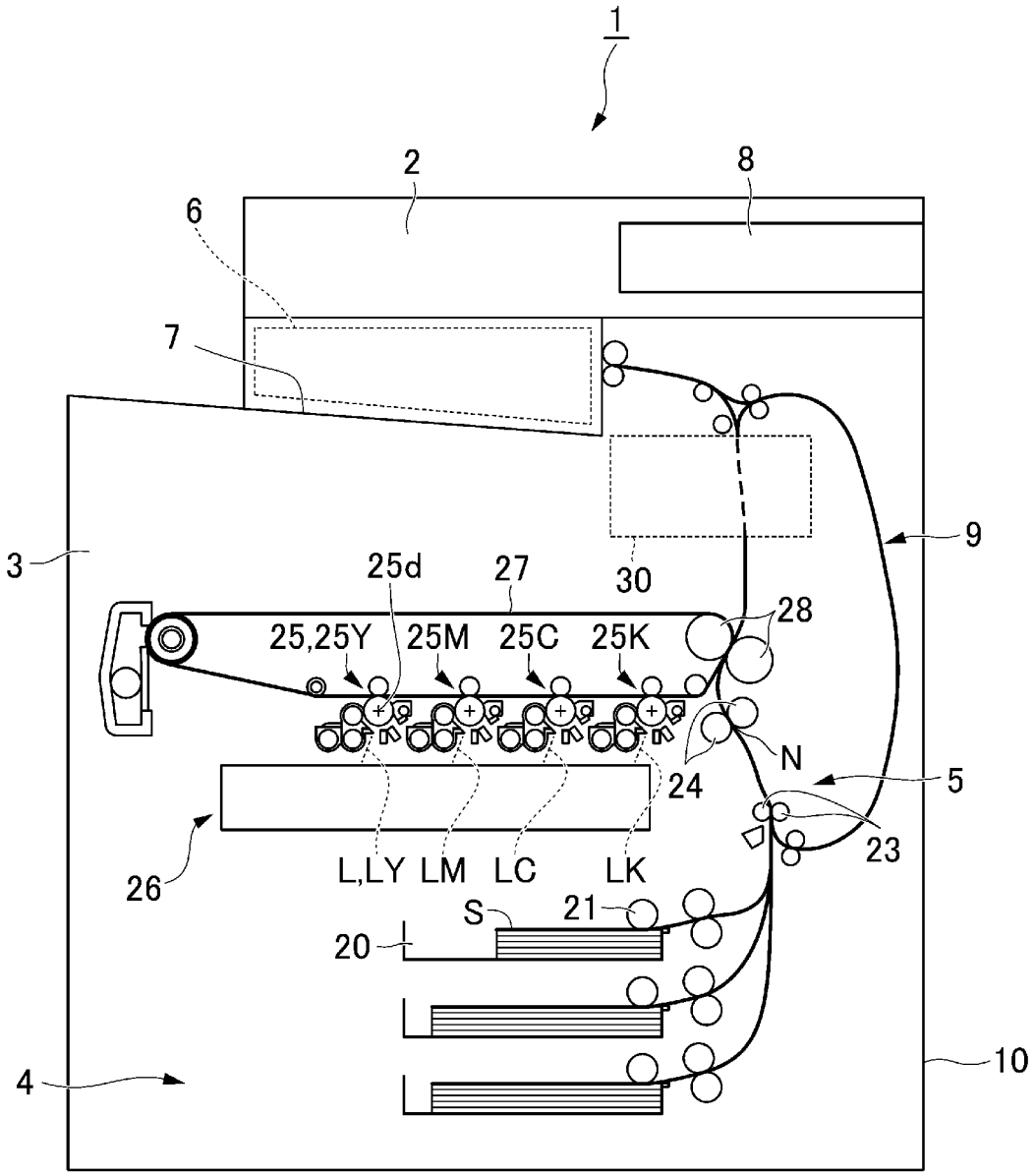
FIG. 1 is a schematic configuration diagram of an image processing apparatus according to an embodiment.

FIG. 1 is a schematic configuration diagram of an image processing apparatus according to the embodiment. The image processing apparatus of the embodiment is an image forming apparatus 1.

The image forming apparatus 1 performs a process of forming an image on a sheet S. The sheet may be paper. The image forming apparatus 1 includes a housing 10, a scanner unit 2, an image forming unit 3, a sheet feeding unit 4, a conveyance unit 5, a tray 7, a reversing unit 9, a control panel 8, and a control unit 6.

The housing 10 forms the outer shape of the image forming apparatus 1.

The scanner unit 2 reads image information of a copy object based on brightness and darkness of light, and generates an image signal. The scanner unit 2 outputs the generated image signal to the image forming unit 3.

The image forming unit 3 forms a toner image based on an image signal from the scanner unit 2 or the outside. A toner image is an image formed of toner or another material. The image forming unit 3 transfers the toner image onto the surface of the sheet S. The image forming unit 3 fixes the toner image onto the sheet S by heating and pressing the toner image on the surface of the sheet S.

The sheet feeding unit 4 supplies the sheets S one by one to the conveyance unit 5 at the timing when the image forming unit 3 forms a toner image. The sheet feeding unit 4 includes a sheet storage unit 20 and a pickup roller 21.

The sheet storage unit 20 stores sheets S of a predetermined size and type.

The pickup roller 21 picks up the sheets S one by one from the sheet storage unit 20. The pickup roller 21 supplies the picked sheet S to the conveyance unit 5.

The conveyance unit 5 conveys the sheet S supplied from the sheet feeding unit 4 to the image forming unit 3. The conveyance unit 5 includes a conveyance roller 23 and a registration roller 24.

The conveyance roller 23 conveys the sheet S supplied from the pickup roller 21 to the registration roller 24. The conveyance roller 23 abuts the leading end of the sheet S in the conveyance direction on a nip N of the registration roller 24.

The registration roller 24 adjusts the position of the leading end of the sheet S in the conveyance direction by bending the sheet S at the nip N. The registration roller 24 conveys the sheet S according to the timing at which the image forming unit 3 transfers the toner image onto the sheet S.

The image forming unit 3 will be described.

The image forming unit 3 includes a plurality of image forming units 25, a laser scanning unit 26, an intermediate transfer belt 27, a transfer unit 28, and a fixing device 30.

The image forming unit 25 includes a photosensitive drum **25*d*. The image forming unit 25 forms a toner image on the photosensitive drum 25*d* according to the image signal. The plurality of image forming units 25Y, 25M, 25C, and 25**K form toner images using yellow, magenta, cyan, and black toners, respectively.

A charger charges the surface of the photosensitive drum **25*d*. The developing device stores a developer containing yellow, magenta, cyan, and black toners. The developing device develops an electrostatic latent image on the photosensitive drum 25*d* in order to form a toner image of each color on the photosensitive drum 25*d***.

The laser scanning unit 26 scans the charged photosensitive drum **25*d* with a laser beam L to expose the photosensitive drum 25*d*. The laser scanning unit 26 exposes the photosensitive drum 25*d* with each of the laser beams LY, LM, LC, and LK to form an electrostatic latent image on the photosensitive drum 25*d* of the image forming unit 25Y, 25M, 25C, or 25**K for each color.

The toner image on the surface of the photosensitive drum **25*d* is primarily transferred to the intermediate transfer belt 27**.

The transfer unit 28 transfers the toner image primarily transferred onto the intermediate transfer belt 27 onto the surface of the sheet S at a secondary transfer position.

The fixing device 30 fixes the toner image to the sheet S by heating and pressing the toner image transferred onto the sheet S.

The reversing unit 9 reverses the sheet S to form an image on the back surface of the sheet S. The reversing unit 9 reverses the sheet S discharged from the fixing device 30 from the front surface to the back surface by switchback. The reversing unit 9 conveys the reversed sheet S toward the registration roller 24.

The tray 7 places a sheet S on which an image is formed and discharged.

The control panel 8 is a part of an input unit for inputting information for an operator to operate the image forming apparatus 1. The control panel 8 includes a touch panel and various hard keys.

The control unit 6 controls each unit of the image forming apparatus 1.

Figure 2:
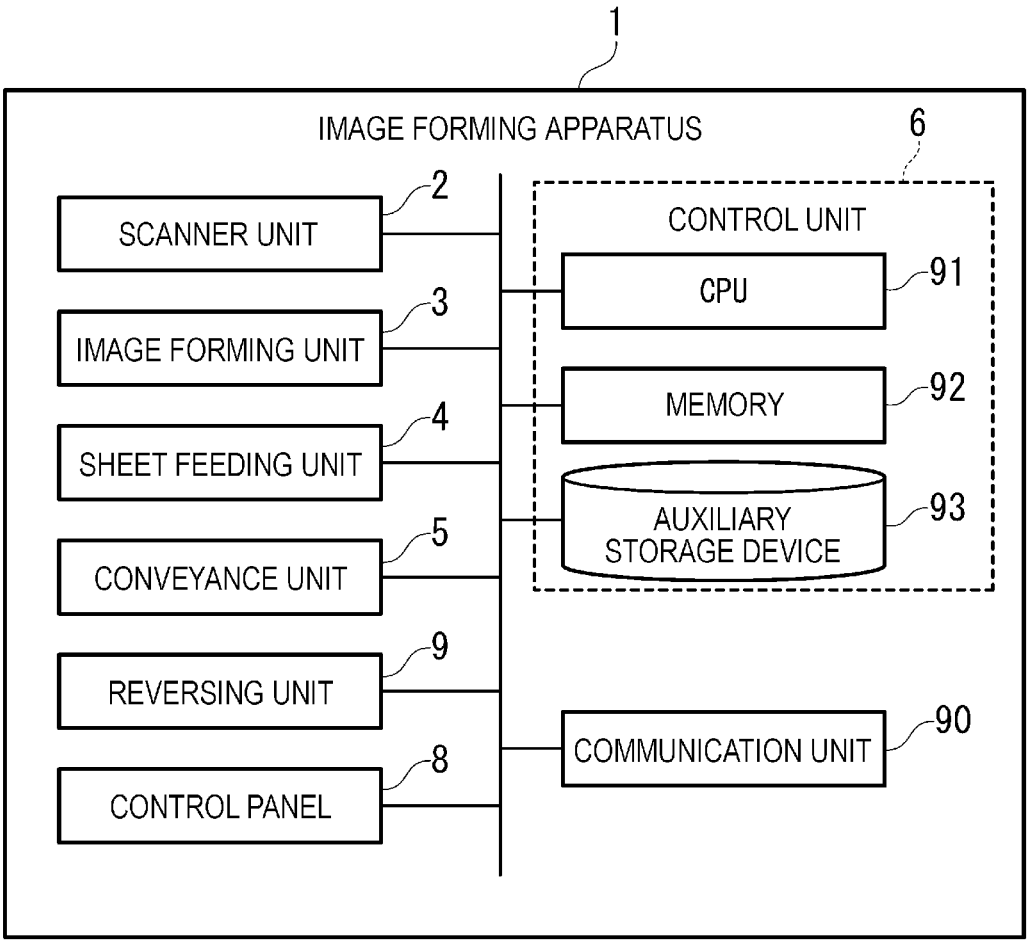
FIG. 2 is a hardware configuration diagram of the image processing apparatus.

FIG. 2 is a hardware configuration diagram of the image processing apparatus of the embodiment. The image forming apparatus 1 includes a central processing unit (CPU) 91, a memory 92, an auxiliary storage device 93, and the like, which are connected by a bus, and executes a program. The image forming apparatus 1 functions as an apparatus including the scanner unit 2, the image forming unit 3, the sheet feeding unit 4, the conveyance unit 5, the reversing unit 9, the control panel 8, and a communication unit 90 by executing a program.

The CPU 91 functions as the control unit 6 by executing a program stored in the memory 92 and the auxiliary storage device 93. The control unit 6 controls the operation of each functional unit of the image forming apparatus 1.

The auxiliary storage device 93 is configured using a storage device such as a magnetic hard disk device or a semiconductor storage device. The auxiliary storage device 93 stores information.

The communication unit 90 includes a communication interface for connecting the own device to an external device. The communication unit 90 communicates with an external device via the communication interface.

The fixing device 30 will be described in detail.

Figure 3:
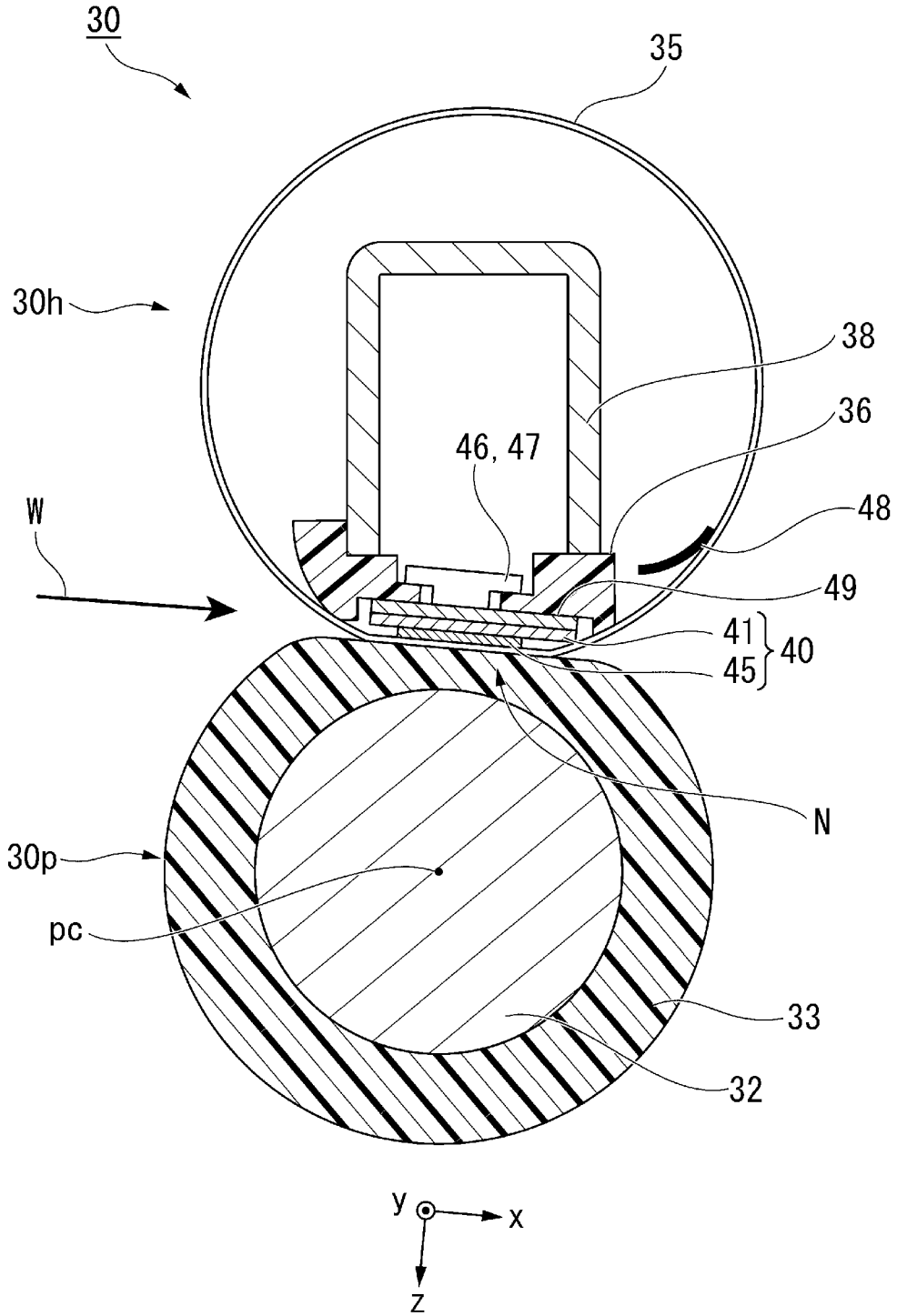
FIG. 3 is a front sectional view of a pressing device according to the embodiment.

FIG. 3 is a front sectional view of the pressing device according to the embodiment. The pressing device of the embodiment is the fixing device 30. The fixing device 30 includes a rotatable member 30*h* and a pressing rotator 30*p*. The nip N is formed between the rotatable member 30*h* and the pressing rotator 30*p*.

In the present application, the z direction, the x direction, and the y direction are defined as follows. The z direction is a direction in which the rotatable member 30*h* and the pressing rotator 30*p* are arranged. The +z direction is a direction from the rotatable member 30*h* toward the pressing rotator 30*p*. The x direction is the sheet conveyance direction in the nip N, and the +x direction is the downstream side in the sheet conveyance direction. The y direction is the central axis direction of the pressing rotator 30*p*.

The rotatable member 30*h* heats the toner image on the sheet S that has entered the nip N. The rotatable member 30*h* includes a cylindrical film 35, a heater unit 40, a heat transfer member 49, a support member 36, a stay 38, a heater thermometer 46 and a thermostat 47, and a film thermometer 48. The rotatable member 30*h* may be a roller.

The cylindrical film 35 has a cylindrical shape. The cylindrical film 35 includes a base layer, an elastic layer, and a release layer in order from the inner peripheral side. The base layer is formed of a material such as nickel (Ni). The elastic layer is formed of an elastic material such as silicone rubber. The release layer is formed of a material such as PFA resin.

The heater unit 40 is inside the cylindrical film 35. The heater unit 40 contacts the inner peripheral surface of the cylindrical film 35 via grease. The heater unit 40 includes a substrate 41 and a heating element 45. The substrate 41 is formed of a metal material such as stainless steel. The heating element 45 is between the substrate 41 and the cylindrical film 35.

The heat transfer member 49 is formed of a metal material having a high thermal conductivity such as copper.

The support members 36 are formed of a resin material such as a liquid crystal polymer. The support members 36 support the heater unit 40 via the heat transfer member 49. The support members 36 support the inner peripheral surface of the cylindrical film 35 at both ends in the x direction of the heater unit 40.

The stay 38 is formed of a steel plate material or the like. The cross section of the stay 38 perpendicular to the y direction has a U shape. Both ends of the stay 38 in the y direction are fixed to the housing of the image forming apparatus 1. The stay 38 supports the rotatable member 30*h* on the image forming apparatus 1.

The heater thermometer 46 and the thermostat 47 are located in the −z direction of the heater unit 40 with the heat transfer member 49 interposed therebetween. The heater thermometer 46 measures the temperature of the heater unit 40 via the heat transfer member 49. The thermostat 47 cuts off the power supply to the heating element 45 when the temperature of the heater unit 40 detected via the heat transfer member 49 exceeds a predetermined temperature.

The film thermometer 48 contacts the inner peripheral surface of the cylindrical film 35 and measures the temperature of the cylindrical film 35.

The configuration of the rotatable member 30*h* is not limited to the above, and various configurations are possible.

The pressing rotator 30*p* presses the toner image on the sheet S that has entered the nip N. The pressing rotator 30*p* includes a cored bar 32 and an elastic layer 33. The configuration of the pressing rotator 30*p* is not limited to the above, and various configurations are possible.

The cored bar 32 is formed in a cylindrical shape using a metal material such as stainless steel. The elastic layer 33 is formed of an elastic material such as silicone rubber. The elastic layer 33 has a certain thickness on the outer peripheral surface of the cored bar 32. The release layer may be a resin material such as PFA (tetrafluoroethylene/perfluoroalkylvinyl ether copolymer) and may be on the outer peripheral surface of the elastic layer 33.

The pressing rotator 30*p* rotates by being driven by a motor. When the pressing rotator 30*p* rotates in a state where the nip N is formed, the cylindrical film 35 of the rotatable member 30*h* is driven to rotate. The pressing rotator 30*p* rotates while the sheet S is present in the nip N, thereby conveying the sheet S in the conveyance direction W.

A pressing rotator moving mechanism 50 will be described in detail.

Figure 4:
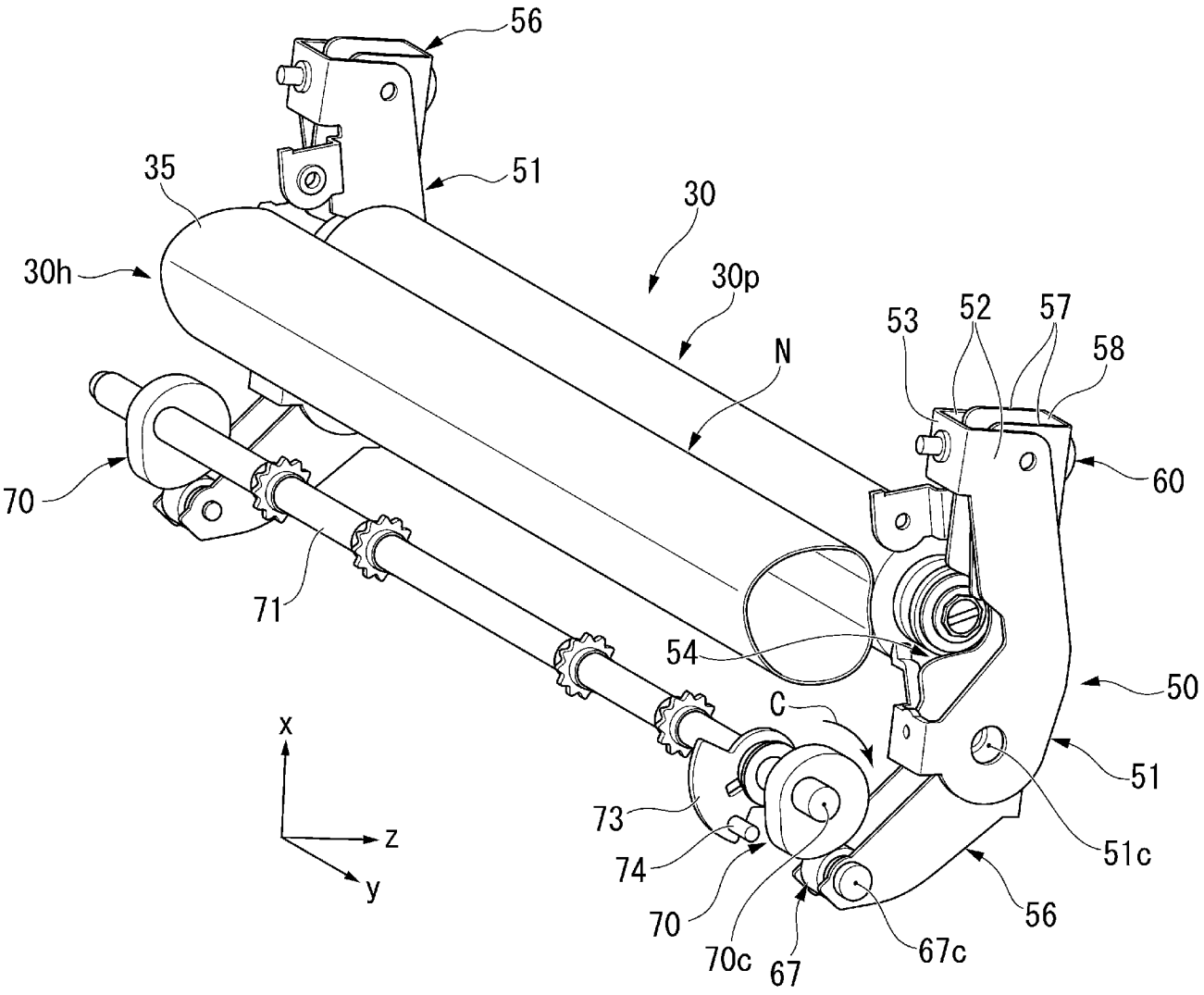
FIG. 4 is a perspective view of a pressing rotator moving mechanism.

FIG. 4 is a perspective view of a pressing rotator moving mechanism. In FIG. 4 and the subsequent drawings, the illustration of members inside the cylindrical film 35 is omitted. The pressing rotator moving mechanism 50 brings the pressing rotator 30*p* into contact with and away from the rotatable member 30*h*. When the pressing rotator 30*p* is brought into contact with the rotatable member 30*h*, the nip N is formed therebetween. The fixing device 30 fixes the toner image on the sheet S by heating and pressing the toner image on the sheet S that has entered the nip N. When the sheet S is jammed in the fixing device 30, the pressing rotator 30*p* is separated from the rotatable member 30*h* so that the sheet S can be removed from the fixing device 30. When the fixing device 30 is in the sleep state, the pressing rotator 30*p* is separated from the rotatable member 30*h* in order to prevent plastic deformation of the cylindrical film 35. The sleep state is, for example, a state in which the heater unit 40 is not energized although the memory 92 is energized, but is not limited thereto.

The pressing rotator moving mechanism 50 includes an arm 51, a pusher 56, a cam follower 67, and a cam 70. The components of the pressing rotator moving mechanism 50 are located at both ends in the y direction of the pressing rotator 30*p*. The pressing rotator moving mechanism 50 is plane-symmetric with respect to the xz plane passing through the center point of the pressing rotator 30*p* in the y direction. Hereinafter, components of the pressing rotator moving mechanism 50 in the +y direction of the pressing rotator 30*p* will be described.

The arm 51 has a length in the x direction. The arm 51 may be formed of a steel plate material or the like. The arm 51 is rotatable around an arm rotation center 51*c*. The arm rotation center 51*c* is near the end of the arm 51 in the −x direction, and is parallel to the y direction.

The arm 51 includes an arm body plate 52 and an arm connecting portion 53.

The arm body plate 52 is parallel to the xz plane. A pair of arm body plates 52 have an interval in the y direction. The arm body plate 52 in the −y direction includes a pressing rotator support unit 54. The pressing rotator support unit 54 is a semicircular notch at the center of the arm body plate 52 in the x direction and at the end in the −z direction. The pressing rotator support unit 54 rotatably supports the pressing rotator 30*p*.

The arm connecting portion 53 connects the ends of the pair of arm body plates 52 and 52 in the −z direction to each other. The arm connecting portions 53 are provided at both ends of the arms 51 in the x direction.

The pusher 56 may be formed of a steel plate material or the like. The pusher 56 is rotatable around the arm rotation center 51*c*. The arm rotation center 51*c* is located at the middle portion of the pusher 56 in the x direction. One side of the pusher 56 has a length in the +x direction from the arm rotation center 51*c*. The other side of the pusher 56 has a length in the −x direction and the −z direction from the arm rotation center 51*c*.

The pusher 56 includes a pusher body plate 57 and a pusher connecting portion 58.

The pusher body plate 57 is parallel to the xz plane. A pair of pusher body plates 57 and 57 have an interval in the y direction. The pair of pusher body plates 57 and 57 are inside the pair of arm body plates 52 and 52 in the y direction.

The pusher connecting portion 58 connects the ends of the pair of pusher body plates 57 and 57 in the +z direction to each other.

Figure 5:
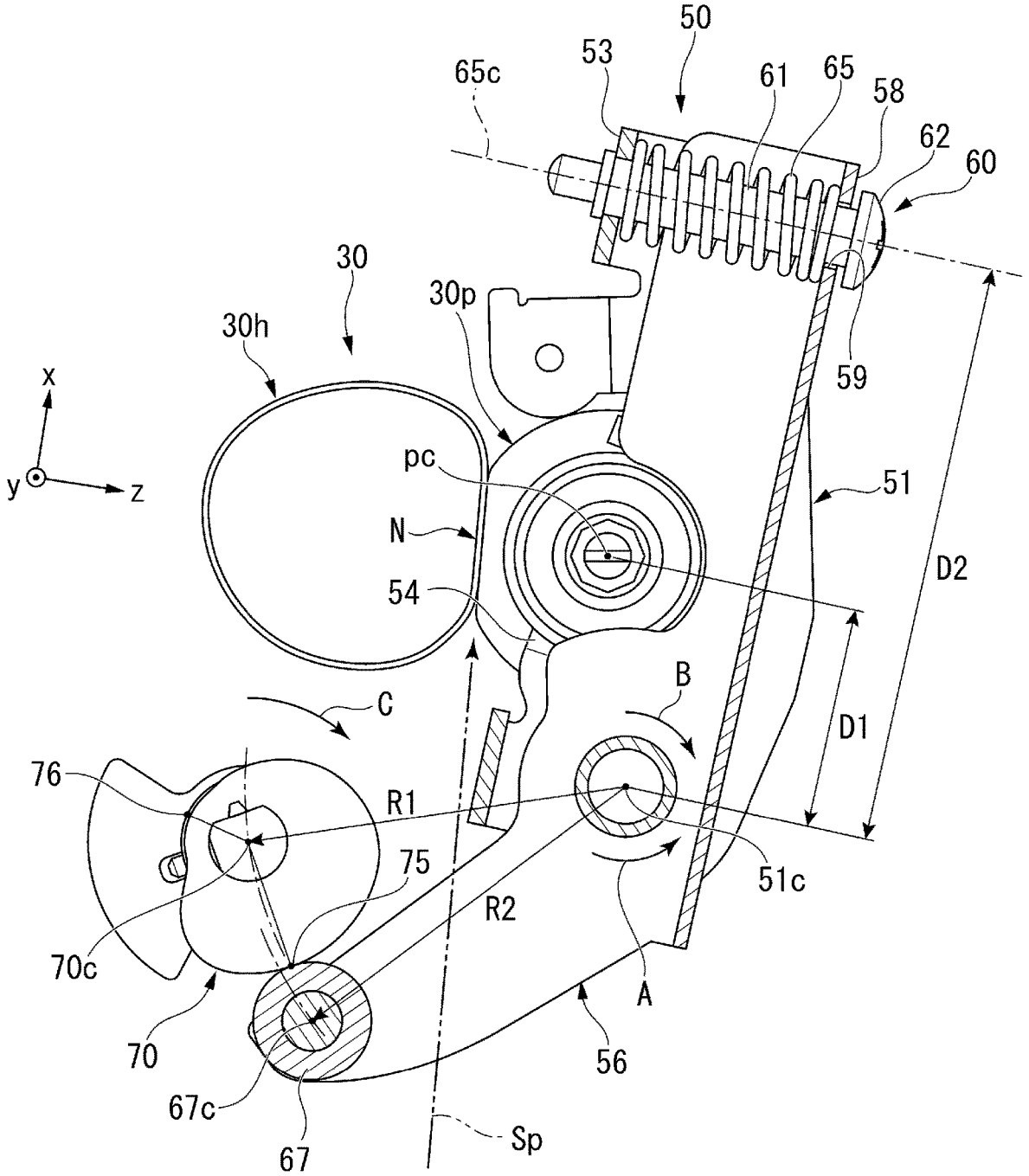
FIG. 5 is a front sectional view of the pressing rotator moving mechanism.

FIG. 5 is a front sectional view of the pressing rotator moving mechanism. FIG. 5 and the subsequent drawings are cross-sectional views perpendicular to the y direction at the middle portion of the pusher 56 in the y direction. The pressing rotator moving mechanism 50 includes an elastic member 65. The elastic member 65 may be a coil spring. The pressing rotator 30*p* rotates around a pressing rotator rotation center pc.

A pin 60 is located at the end in the +x direction of the arm 51 and the pusher 56. The pin 60 runs along the z direction. The pin 60 includes a trunk portion 61 and a head portion 62.

The trunk portion 61 has a round bar shape. A first end in the −z direction of the trunk portion 61 is fixed to the arm connecting portion 53 by screwing or the like. The trunk portion 61 has a length in the +z direction from the arm connecting portion 53 toward the pusher connecting portion 58. The pusher connecting portion 58 includes a through-hole 59 having a larger diameter than the trunk portion 61. The trunk portion 61 is inserted into the through-hole 59 and has a length up to the +z direction of the pusher connecting portion 58.

The head portion 62 is located at a second end of the trunk portion 61 in the +z direction. The head portion 62 has a larger diameter than the through-hole 59.

The elastic member 65 is located between the arm 51 and the pusher 56. The elastic member 65 is located between the arm connecting portion 53 and the pusher connecting portion 58 in a compressed state. The elastic member 65 biases the arm 51 in a direction in which the pressing rotator 30*p* contacts the rotatable member 30*h*. The elastic member 65 is coaxial with the trunk portion 61 of the pin 60.

The elastic member 65 is on the same side (+x direction) as the pressing rotator rotation center pc with respect to the arm rotation center 51*c*. The distance D2 from the arm rotation center 51*c* to a central axis 65*c* of the elastic member 65 is longer than the distance D1 from the arm rotation center 51*c* to the pressing rotator rotation center pc. According to the configuration, by the principle of leverage, the pressing rotator 30*p* is pressed against the rotatable member 30*h* with a force greater than the biasing force of the elastic member 65.

The cam follower 67 is located at the end of the pusher 56 in the −x direction and the −z direction. As illustrated in FIG. 4, the cam follower 67 has a cylindrical shape and is located between the pair of pusher body plates 57 and 57. The cam follower 67 is a roller that is rotatable around a cam follower rotation center 67*c* parallel to the y direction.

The cam 70 is located in the +x direction of the cam follower 67, adjacent to the cam follower 67. The cam surface constituting the contour of the cam 70 can contact the outer peripheral surface of the cam follower 67. A pair of cams 70 at both ends in the y direction of the pressing rotator 30*p* are connected by a camshaft 71. The camshaft 71 is rotationally driven by a motor via a worm gear or the like. The cam 70 is rotatable in the direction of an arrow C around a cam rotation center 70*c*. A first rotation center is, for example, the cam rotation center 70*c*.

As illustrated in FIG. 5, the cam rotation center 70*c* is on the opposite side of the pressing rotator rotation center pc across the arm rotation center 51*c*. The camshaft 71 is on the upstream side of the nip N and not on the downstream side of the nip N.

When a sheet is jammed in the nip N, the sheet S is removed from the downstream side of the nip N. Since the camshaft 71 is not on the downstream side of the nip N, the work of removing the sheet S becomes easy.

The pusher 56 has a length in the −x direction and the −z direction from the arm rotation center 51*c*. The cam follower 67 is provided at the tip of the pusher 56 in the −x direction and −z direction. The cam 70 is adjacent to the cam follower 67. The cam rotation center 70*c* is closer to the rotatable member 30*h* side (−z direction) than the nip N formed by the pressing rotator 30*p* and the rotatable member 30*h*.

A conveyance path Sp of the sheet S on the upstream side of the nip N is a plane including the nip N. The camshaft 71 is located in the −z direction of the nip N together with the cam rotation center 70*c*. The camshaft 71 does not block the conveyance path Sp of the sheet S.

Since the distance R1 from the arm rotation center 51*c* to the cam rotation center 70*c* is shorter than the distance R2 from the arm rotation center 51*c* to the cam follower rotation center 67*c*, abnormal noise caused by the contact between the cam 70 and the cam follower 67 is prevented.

The operation of the pressing rotator moving mechanism 50 will be described.

When the fixing operation is performed by the fixing device 30, the pressing rotator moving mechanism 50 causes the pressing rotator 30*p* to abut on the rotatable member 30*h*. FIG. 5 illustrates a state where the pressing rotator 30*p* is brought into contact with the rotatable member 30*h*. The cam 70 is in contact with the cam follower 67 at a first position 75. The first position 75 is a contact position of the cam 70 with the cam follower 67 when the pressing rotator 30*p* and the rotatable member 30*h* are arranged in contact with each other. The first position 75 in the contour of the cam 70 is a position far from the cam rotation center 70*c*.

Figure 6:
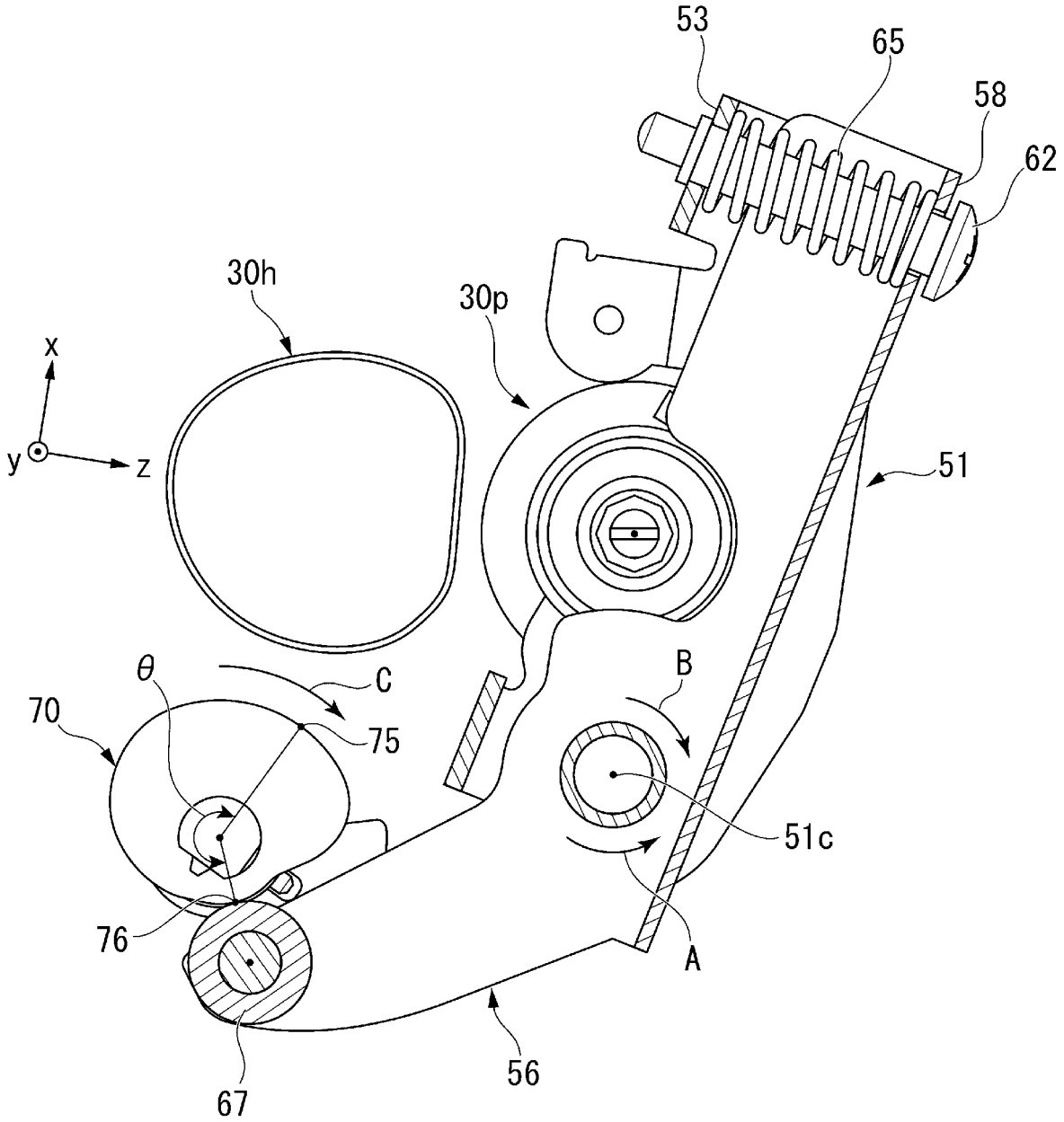
FIG. 6 is an explanatory diagram of the operation of the pressing rotator moving mechanism.

FIG. 6 is an explanatory diagram of the operation of the pressing rotator moving mechanism. FIG. 6 illustrates a state where the pressing rotator 30*p* is separated from the rotatable member 30*h*. The cam 70 is in contact with the cam follower 67 at a second position 76. The second position 76 is a contact position of the cam 70 with the cam follower 67 when the pressing rotator 30*p* and the rotatable member 30*h* are arranged apart from each other. The second position 76 in the contour of the cam 70 is a position close to the cam rotation center 70*c*.

As illustrated in FIG. 4, a fan-shaped member 73 is mounted on the camshaft 71. When the cam 70 is in contact with the cam follower 67 at the first position 75 and the second position 76, a sensor 74 detects both ends of the fan-shaped member 73 in the circumferential direction of the camshaft 71.

The contact operation of the pressing rotator 30*p* with the rotatable member 30*h* will be described.

From the state of FIG. 6, the cam 70 rotates in the direction of the arrow C. The cam 70 pushes the cam follower 67 in the direction of an arrow A. The pusher 56 supporting the cam follower 67 rotates around the arm rotation center 51*c* in the direction of the arrow A. The pusher connecting portion 58 presses the arm connecting portion 53 via the elastic member 65 in the −z direction. The arm 51 rotates in the direction of the arrow A around the arm rotation center 51*c* in order to bring the pressing rotator 30*p* into contact with the rotatable member 30*h*.

When the cam 70 further rotates in the direction of the arrow C, the pusher 56 rotates around the arm rotation center 51*c* in the direction of the arrow A. The pusher connecting portion 58 is separated from the head portion 62 of the pin 60 and compresses the elastic member 65. The elastic member 65 strongly presses the arm connecting portion 53 in the −z direction. The arm 51 rotates around the arm rotation center 51*c* in the direction of the arrow A. As in the state of FIG. 5, the pressing rotator 30*p* is pressed against the rotatable member 30*h* to form the nip N, and the cam 70 contacts the cam follower 67 at the first position 75.

The pusher 56 is rotatable around the arm rotation center 51*c*. The rotation centers of the pusher 56 and the arm 51 coincide. When the pusher 56 rotates to compress the elastic member 65, the elastic member 65 is compressed in parallel with the central axis 65*c*. Interference between the through-hole 59 of the pusher connecting portion 58 and the trunk portion 61 of the pin 60 is avoided. Such a structure stabilizes the operation of the pressing rotator moving mechanism 50.

The operation of separating the pressing rotator 30*p* from the rotatable member 30*h* will be described.

From the state of FIG. 5, the cam 70 rotates in the direction of the arrow C. The cam follower 67 approaches the cam rotation center 70*c* while relatively moving along the contour of the cam 70. Due to the restoring force of the elastic member 65, the pusher 56 rotates in the direction of an arrow B around the arm rotation center 51*c*. The distance between the pusher connecting portion 58 and the arm connecting portion 53 increases, and the compression of the elastic member 65 is reduced. The arm 51 rotates in the direction of the arrow B around the arm rotation center 51*c* due to the decrease in the pressing force of the arm connecting portion 53 by the elastic member 65 and the restoring force of the pressing rotator 30*p*.

When the cam 70 further rotates in the direction of the arrow C, the pusher 56 rotates in the direction of the arrow B around the arm rotation center 51*c*. The pusher connecting portion 58 contacts on the head portion 62 of the pin 60, and the distance between the pusher connecting portion 58 and the arm connecting portion 53 is fixed. The arm 51 rotates together with the pusher 56 in the direction of the arrow B around the arm rotation center 51*c*. As in the state of FIG. 6, the pressing rotator 30*p* is separated from the rotatable member 30*h*, and the cam 70 contacts the cam follower 67 at the second position 76.

In the separation operation of the pressing rotator 30*p*, the pusher 56 rotates in the direction of the arrow B around the arm rotation center 51*c*. As illustrated in FIG. 5, the distance R1 from the arm rotation center 51*c* to the cam rotation center 70*c* is shorter than the distance R2 from the arm rotation center 51*c* to the cam follower rotation center 67*c*. The cam 70 is located at a position for receiving the movement of the cam follower 67 supported by the pusher 56. The restoring force of the elastic member 65 presses the cam follower 67 toward the cam 70. Such a structure prevents the temporary separation between the cam 70 and the cam follower 67 due to the rotation of the cam 70 and prevents abnormal noise caused by the contact between the cam 70 and the cam follower 67.

In the separation operation of the pressing rotator 30*p*, when the cam 70 rotates in the direction of the arrow C, the contact position between the cam 70 and the cam follower 67 moves from the first position 75 to the second position 76. The contour of the cam 70 from the first position 75 to the second position 76 in the separation operation of the cam 70 is smooth and continuous. The inclination of the tangent in the contour of the cam 70 changes little by little, and the radius of curvature of the contour of the cam 70 gradually decreases. Since the contour of the cam 70 from the first position 75 to the second position 76 in the separation operation of the cam 70 has no dent, the temporary separation between the cam 70 and the cam follower 67 due to the rotation of the cam 70 is prevented, and abnormal noise caused by the contact between the cam 70 and the cam follower 67 is prevented.

As illustrated in FIG. 6, the rotation angle θ of the cam 70 from the first position 75 to the second position 76 in the separation operation of the cam 70 is 180 degrees or more. In the example of FIG. 6, the rotation angle θ is about 225 degrees. When the cam 70 rotates at a constant angular velocity, the time for the separation operation of the cam 70 becomes longer. The cam follower 67 easily follows the contour of the cam 70, the temporary separation between the cam 70 and the cam follower 67 is prevented, and abnormal noise caused by the contact between the cam 70 and the cam follower 67 is prevented.

Figure 7:
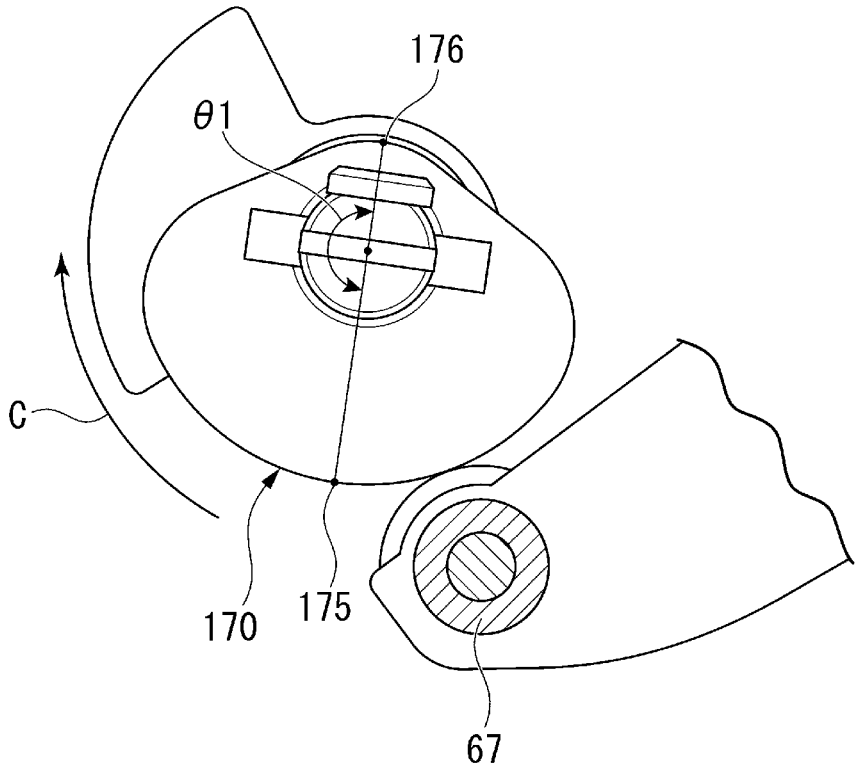
FIG. 7 is a front view of a cam according to a modification of the embodiment.

FIG. 7 is a front view of a cam according to a modification of the embodiment. The cam 70 of the embodiment and a cam 170 of the modification have different contour shapes. A description of a modification similar to the embodiment will be omitted.

When the pressing rotator 30*p* and the rotatable member 30*h* are arranged in contact with each other, the cam 170 contacts the cam follower 67 at a first position 175. When the pressing rotator 30*p* and the rotatable member 30*h* are arranged apart from each other, the cam 170 contacts the cam follower 67 at a second position 176.

The contour of the cam 170 from the first position 175 to the second position 176 in the separation operation of the cam 170 is smooth and continuous. A rotation angle θ1 of the cam 170 from the first position 175 to the second position 176 in the separation operation of the cam 170 is 180 degrees or more. In the example of FIG. 7, the rotation angle θ1 is about 180 degrees. Even in the case of the modification, the temporary separation between the cam 170 and the cam follower 67 is prevented, and abnormal noise due to contact between the cam 170 and the cam follower 67 is prevented.

As described in detail above, the fixing device 30 of the embodiment includes the rotatable member 30*h*, the pressing rotator 30*p*, the arm 51, the pusher 56, the elastic member 65, the cam follower 67, and the cam 70. The pressing rotator 30*p* can contact the rotatable member 30*h*. The arm 51 rotatably supports the pressing rotator 30*p* and changes the distance from the pressing rotator rotation center pc to the rotatable member 30*h* by rotation. The pusher 56 is rotatable around the arm rotation center 51*c*. The elastic member 65 is located between the arm 51 and the pusher 56 and biases the arm 51 in a direction in which the pressing rotator 30*p* contacts the rotatable member 30*h*. The cam follower 67 is mounted on the pusher 56. The cam 70 can contact the cam follower 67 and is rotatable around the cam rotation center 70*c*. The distance R1 from the arm rotation center 51*c* to the cam rotation center 70*c* is shorter than the distance R2 from the arm rotation center 51*c* to the cam follower rotation center 67*c*.

Since the distance R1 is shorter than the distance R2, the cam 70 is at a position for receiving the movement of the cam follower 67 in the separation operation of the pressing rotator 30*p*. Such a structure prevents temporary separation of the cam 70 from the cam follower 67 due to the rotation, and prevents abnormal noise caused by the contact between the cam 70 and the cam follower 67.

The pusher 56 is rotatable around the arm rotation center 51*c*. When the pusher 56 rotates to compress the elastic member 65, the elastic member 65 is compressed in parallel with the central axis 65*c*.

The contact position of the cam 70 with the cam follower 67 when the pressing rotator 30*p* and the rotatable member 30*h* are arranged in contact with each other is defined as the first position 75. The contact position of the cam 70 with the cam follower 67 when the pressing rotator 30*p* and the rotatable member 30*h* are arranged apart from each other is defined as the second position 76. The rotation angle of the cam 70 from the first position 75 to the second position 76 is 180 degrees or more.

Such a structure prolongs the time of the separation operation of the cam 70, and thus, the cam follower 67 can easily follow the contour of the cam 70. The temporary separation between the cam 70 and the cam follower 67 is prevented and abnormal noise caused by the contact between the cam 70 and the cam follower 67 is prevented.

An elastic member 65 between the arm 51 and the pusher 56 in a compressed state prevents abnormal noise caused by the contact between the cam 70 and the cam follower 67.

The pin 60 including the trunk portion 61 and the head portion 62 is provided. The first end in the −z direction of the trunk portion 61 is fixed to the arm 51. The trunk portion 61 has a length from the first end toward the pusher 56, and is inserted into the through-hole 59 having a larger diameter than the trunk portion 61 of the pusher 56. The head portion 62 has a larger diameter than the through-hole 59 and is located at the second end of the trunk portion 61 in the +z direction.

Such a structure enables the pusher 56 and the arm 51 to be interlocked in the contact operation and the separation operation of the pressing rotator 30*p*. In the contact state of the pressing rotator 30*p*, the biasing force of the elastic member 65 presses the pressing rotator 30*p* against the rotatable member 30*h*.

The elastic member 65 is coaxial with the trunk portion 61 between the arm 51 and the pusher 56.

According to the configuration, abnormal deformation of the elastic member 65 is prevented by the trunk portion 61, and the operation of the fixing device 30 is stabilized.

The cam rotation center 70*c* is on the opposite side of the pressing rotator rotation center pc across the arm rotation center 51*c*.

A camshaft 71 for rotating the cam 70 is located on the upstream side of the nip N and not on the downstream side of the nip N. When a sheet is jammed in the nip N, the camshaft 71 does not hinder the removal of the sheet S from the downstream side of the nip N.

The cam rotation center 70*c* is closer to the rotatable member 30*h* than the nip N formed by the pressing rotator 30*p* and the rotatable member 30*h*.

The conveyance path Sp of the sheet S on the upstream side of the nip N is a plane including the nip N. According to the above configuration, the camshaft 71 for rotating the cam 70 is closer to the rotatable member 30*h* side than the nip N. The camshaft 71 does not block the conveyance path Sp of the sheet S.

The elastic member 65 is located on the same side as the pressing rotator rotation center pc with respect to the arm rotation center 51*c*. The distance D2 from the arm rotation center 51*c* to the elastic member 65 is longer than the distance D1 from the arm rotation center 51*c* to the pressing rotator rotation center pc.

According to the configuration, by the principle of leverage, the pressing rotator 30*p* is pressed against the rotatable member 30*h* with a force greater than the biasing force of the elastic member 65.

Since the image forming apparatus 1 includes the fixing device 30 described above, abnormal noise can be prevented.

The image processing apparatus of the embodiment is the image forming apparatus 1, and the pressing device is the fixing device 30. On the other hand, the image processing apparatus may be a decoloring device, and the pressing device may be a decoloring unit. The decoloring device performs a process of decoloring an image formed on a sheet with the decolorable toner. The decoloring unit heats and decolors the decolorable toner image formed on the sheet passing through the nip.

According to at least one embodiment described above, the distance R1 from the arm rotation center 51*c* to the cam rotation center 70*c* is shorter than the distance R2 from the arm rotation center 51*c* to the cam follower rotation center 67*c*. Such a structure prevents abnormal noise caused by the contact between the cam 70 and the cam follower 67.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A pressing device, comprising:
a rotatable member;
a pressing rotator configured to contact the rotatable member;
an arm configured to rotatably support the pressing rotator and to change a distance between a rotation center of the pressing rotator and the rotatable member by rotation;
a pusher rotatable around a rotation center of the arm;
an elastic member located between the arm and the pusher and configured to bias the arm in a direction in which the pressing rotator contacts the rotatable member;
a cam follower mounted on the pusher; and
a cam configured to contact the cam follower and to rotate around a first rotation center, in which a distance between the rotation center of the arm and the first rotation center is shorter than a distance from the rotation center of the arm to the center of the cam follower.

2. The pressing device according to claim 1, wherein
the pressing rotator is configured to separate from the rotatable member.

3. The pressing device according to claim 2, wherein
a rotation angle of the cam, from a contact position of the cam with the cam follower when the pressing rotator and the rotatable member are in contact with each other, up to a contact position of the cam with the cam follower when the pressing rotator and the rotatable member are apart from each other, is 180 degrees or more.

4. The pressing device according to claim 1, wherein
the elastic member is located between the arm and the pusher in a compressed state.

5. The pressing device according to claim 1, further comprising:
a pin including a trunk portion and a head portion, wherein
a first end of the trunk portion is fixed to the arm,
the trunk portion has a length from the first end toward the pusher, and is inserted into a through-hole having a larger diameter than the trunk in the pusher, and
the head portion has a diameter larger than a diameter of the through-hole and is located at a second end of the trunk portion.

6. The pressing device according to claim 5, wherein
the elastic member is a coil spring and is coaxial with the trunk portion between the arm and the pusher.

7. The pressing device according to claim 1, wherein
the first rotation center of the cam is on an opposite side of the rotation center of the pressing rotator across the rotation center of the arm.

8. The pressing device according to claim 7, wherein
the first rotation center of the cam is closer to the rotatable member than a nip formed by the pressing rotator and the rotatable member.

9. The pressing device according to claim 1, wherein
the elastic member is on a same side as the rotation center of the pressing rotator with respect to the rotation center of the arm, and
a distance from the rotation center of the arm to the elastic member is longer than a distance from the rotation center of the arm to the rotation center of the pressing rotator.

10. The pressing device according to claim 1, wherein
the rotatable member includes a heating element.

11. An image processing apparatus, comprising:
a scanner,
an image forming unit,
a sheet feeder,
a conveyance unit, and
a pressing device, comprising:
a rotatable member;
a pressing rotator configured to contact the rotatable member;
an arm configured to rotatably support the pressing rotator and to change a distance between a rotation center of the pressing rotator and the rotatable member by rotation;
a pusher rotatable around a rotation center of the arm;
an elastic member located between the arm and the pusher and configured to bias the arm in a direction in which the pressing rotator contacts the rotatable member;
a cam follower mounted on the pusher; and
a cam configured to contact the cam follower and to rotate around a first rotation center, in which a distance between the rotation center of the arm and the first rotation center is shorter than a distance from the rotation center of the arm to the center of the cam follower.

12. The image processing apparatus according to claim 11, wherein
the pressing rotator is configured to separate from the rotatable member.

13. The image processing apparatus according to claim 12, wherein
a rotation angle of the cam, from a contact position of the cam with the cam follower when the pressing rotator and the rotatable member are in contact with each other, up to a contact position of the cam with the cam follower when the pressing rotator and the rotatable member are apart from each other, is 180 degrees or more.

14. The image processing apparatus according to claim 11, wherein
the elastic member is located between the arm and the pusher in a compressed state.

15. The image processing apparatus according to claim 11, further comprising:
a pin including a trunk portion and a head portion, wherein
a first end of the trunk portion is fixed to the arm,
the trunk portion has a length from the first end toward the pusher, and is inserted into a through-hole having a larger diameter than the trunk in the pusher, and
the head portion has a diameter larger than a diameter of the through-hole and is located at a second end of the trunk portion.

16. The image processing apparatus according to claim 15, wherein
the elastic member is a coil spring and is coaxial with the trunk portion between the arm and the pusher.

17. The image processing apparatus according to claim 11, wherein the first rotation center of the cam is on an opposite side of the rotation center of the pressing rotator across the rotation center of the arm.

18. The image processing apparatus according to claim 17, wherein the first rotation center of the cam is closer to the rotatable member than a nip formed by the pressing rotator and the rotatable member.

19. The image processing apparatus according to claim 11, wherein the elastic member is on a same side as the rotation center of the pressing rotator with respect to the rotation center of the arm, and a distance from the rotation center of the arm to the elastic member is longer than a distance from the rotation center of the arm to the rotation center of the pressing rotator.

20. The image processing apparatus according to claim 11, wherein the rotatable member includes a heating element.

* * * * *